US009475603B2

(12) United States Patent
Jacomelli et al.

(10) Patent No.: US 9,475,603 B2
(45) Date of Patent: Oct. 25, 2016

(54) PACKAGING BOXES WITH CENTERING TAB, CUTOUTS AND SET OF CUTOUTS, METHOD AND DEVICE FOR PRODUCING SUCH BOXES

(71) Applicant: Otor, Puteaux (FR)

(72) Inventors: Sebastien Jacomelli, Laives (FR); Gerard Mathieu, Cergy (FR)

(73) Assignee: Otor, S.A., Paris (FR)

( * ) Notice: Subject to any disclaimer, the term of this patent is extended or adjusted under 35 U.S.C. 154(b) by 9 days.

(21) Appl. No.: 14/375,849

(22) PCT Filed: Feb. 1, 2013

(86) PCT No.: PCT/FR2013/050225

§ 371 (c)(1),
(2) Date: Jul. 31, 2014

(87) PCT Pub. No.: WO2013/114060

PCT Pub. Date: Aug. 8, 2013

(65) Prior Publication Data

US 2015/0021226 A1 Jan. 22, 2015

(30) Foreign Application Priority Data

Feb. 3, 2012 (FR) ..... 12 00337

(51) Int. Cl.

| | |
|---|---|
| ***B65D 21/032*** | (2006.01) |
| ***B65D 21/036*** | (2006.01) |
| ***B65D 5/00*** | (2006.01) |
| ***B31B 1/00*** | (2006.01) |

(Continued)

(52) U.S. Cl.

CPC ..... *B65D 5/005* (2013.01); *B31B 1/00* (2013.01); *B31B 1/20* (2013.01); *B31B 1/26* (2013.01); *B31B 1/90* (2013.01); *B65D 5/001* (2013.01); *B65D 21/0223* (2013.01); *B65D 25/00* (2013.01); *B31B 2201/0241* (2013.01); *B31B 2201/0282* (2013.01); *B31B 2201/2604* (2013.01); *B31B 2201/289* (2013.01); *B31B 2217/103* (2013.01)

(58) Field of Classification Search

None

See application file for complete search history.

(56) References Cited

U.S. PATENT DOCUMENTS 6,234,385 B1 * 5/2001 Espinoza ..... B65D 5/2038 229/122
6,257,411 B1 * 7/2001 Bacques ..... B65D 5/001 206/508

(Continued)

FOREIGN PATENT DOCUMENTS

DE 202010010168 U1 10/2010
EP 1153841 A1 11/2001

(Continued)

OTHER PUBLICATIONS

International Search Report of PCT/FR2013/050225, dated Apr. 24, 2013.

*Primary Examiner* — Gary Elkins
(74) *Attorney, Agent, or Firm* — Banner & Witcoff, Ltd.

(57) ABSTRACT

A packaging box, cutouts, method and device for producing corrugated cardboard boxes comprising walls, a base (6) and a cover (7), the inner face of the base being provided with at least two recesses (33) and the cover comprising at least two tabs (38) adhered to the upper face thereof, directly above the recesses of complementary shape. The recesses and/or the tabs are situated fully inside the corresponding face or faces (31, 32).

33 Claims, 15 Drawing Sheets

(51) Int. Cl.

| | |
|---|---|
| ***B31B 1/20*** | (2006.01) |
| ***B31B 1/26*** | (2006.01) |
| ***B31B 1/90*** | (2006.01) |
| ***B65D 21/02*** | (2006.01) |
| ***B65D 25/00*** | (2006.01) |

(56) References Cited

U.S. PATENT DOCUMENTS

| | | | | |
|---|---|---|---|---|
| 6,935,504 | B2 * | 8/2005 | Ritter | B65D 5/0045 206/511 |
| 2005/0098469 | A1 * | 5/2005 | Agakanian | B65D 21/0204 206/503 |
| 2011/0000957 | A1 * | 1/2011 | Delause | B65D 5/001 229/125.01 |
| 2013/0213847 | A1 * | 8/2013 | Moreau | B65D 5/001 206/509 |
| 2014/0113789 | A1 * | 4/2014 | Aganovic | B31B 1/00 493/162 |

FOREIGN PATENT DOCUMENTS

| | | | |
|---|---|---|---|
| FR | 2757833 | A1 | 7/1998 |
| FR | 2761341 | A1 | 10/1998 |
| FR | 2925880 | A1 | 7/2009 |
| GB | 2324293 | A | 10/1998 |

* cited by examiner

PACKAGING BOXES WITH CENTERING TAB, CUTOUTS AND SET OF CUTOUTS, METHOD AND DEVICE FOR PRODUCING SUCH BOXES

The present invention relates to boxes made of corrugated board, comprising walls, a bottom and a top, the lower face of the bottom being provided with recesses and the top comprising tongues on its upper face, in line with the recesses, of complementary shape.

It also relates to cutouts or sets of cutouts for forming such boxes, as well as to a method and device for manufacturing boxes from said cutouts or said sets of cutouts.

It has a particular important, although not exclusive, application in the field of boxes which can be stacked on pallets, which may have a tendency to slide with respect to one another during their handling or during the transport phases.

Systems are already known for centering boxes, making it possible to avoid their sliding by lateral studs cooperating with orifices placed on the edges, or close thereto.

Such systems are fragile and do not withstand repeated handling.

Packaging units are also known (FR-A-2.311.717), the lid of which is formed by tabs, some of which have a shape complementary to that of notches formed in the bottom, which is also formed by tabs, allowing interlocking and therefore lateral blocking.

Other than the fact that such an embodiment requires a blank shape with a double set of tabs, it is not suitable for low grammage and does not always allow perfect vertical stacking because of offsets which may exist during the formation of the box.

A box is also known which has a top with tongues held in the side walls and adhesively bonded onto the upper face thereof, by folding about the folding line between walls and tabs.

Although such a box allows good centering and excellent blocking, it generally leads to weakening of the walls.

It is an object of the present invention to provide a box, a set of cutouts, and a device and a method for mounting, which meet practical requirements better than those previously known, in particular because on the one hand it proposes centering of the boxes on one another, allowing perfect stacking of the boxes, and on the other hand it allows simple and inexpensive formation of the boxes.

With the invention, it will therefore be possible to avoid any sliding of the packaging units when they are stacked on one another during their palleting, and thus to permit the use of lightweight grammage, and to do so while avoiding the use of expensive palleting accessories which entail additional handling.

The configuration of the boxes furthermore allows optimized load-bearing of the weights of the upper boxes on the lower boxes, by allowing excellent centering of the walls in line with one another.

To this end, the present invention provides in particular a packaging box comprising walls, a bottom and a top, the lower face of the bottom being provided with at least two recesses and the top comprising at least two tongues adhesively bonded onto its upper face, in line with the recesses of complementary shape, characterized in that the recesses and/or the tongues are entirely located inside the corresponding face or faces.

The term "entirely located inside" is intended to mean that all these edges, whether they are cut out or connected to the board, are inside the face, that is to say at least several mm from the folding or separation line between walls and bottom and/or top, and for example at least 5 mm inside the face with respect to said folding line, or advantageously and for example at least 1 cm, at least 2 cm or at least 5 cm.

Advantageously all the recesses and all the tongues are entirely located inside the corresponding face.

In advantageous embodiments, one and/or other of the following arrangements is furthermore implemented:

- the tongues are each formed by a portion of the upper face of the top, cut out on a first part and connected by a second part to said face by a folding line;
- the portion forming the tongues is rectangular or trapezoidal, the first part being delimited by three sides and the second part by the fourth side forming the folding line;
- the tongues have a first part of rounded shape, for example of half-moon, semi-round or semi-oval shape;
- the box is formed from a blank comprising a series of at least four main flaps, two of the main flaps forming the bottom and the top of the box, and the other two forming two opposing first side walls, said series being provided on one side with a first set of tabs and on the other side with a second set of tabs, said sets at least partly forming the other two side walls adjacent to the opposing first walls, said recesses and said tongues being formed in said main flaps forming the bottom and the top;
- the tongues and the recesses are central with respect to the flaps in question, and respectively symmetrical with respect to a central longitudinal axis of the series of flaps.

"Central with respect to the flaps" is intended to mean that they are located on a line separating the flap into two equal parts, which are perpendicular to the central longitudinal axis of the series of flaps;

- the tongues and the recesses are symmetrical with respect to a central point of the flap in question;
- the folding line of the second part of the tongues formed by a portion of the upper face of the top is located at a distance from the junction line between tabs and corresponding main flaps equal to the width of the tongue;
- the box is formed from a blank comprising a series of at least four main flaps forming the side walls of the box, said series being provided on one side with a first set of tabs forming the bottom of the box and on the other side with a second set of tabs forming the top, said recesses and said tongues being formed in said tabs;
- the tongues and the recesses are centered in width of the tab with respect to the tabs in question;
- each tab in question comprises two recesses or two tongues;
- the tongues have their first cut-out part opposite the second part connected to the face by a folding line, which coincides with the external edge of the corresponding tab;
- the recesses are located at the border of a lateral side of the corresponding tab;
- the recesses have a cut-out side which coincides or substantially coincides with the junction line between tabs and corresponding main flaps;
- the box comprises eight sides, namely four main flaps and four intermediate flaps forming cut corners, and in that it is formed around a mandrel;
- the box is formed from two cutouts of corrugated sheet board material, namely a first cutout capable of forming a tray for the bottom of the box and a second cutout capable of forming the top of said box, said first cutout comprising the tongues or the recesses and said second cutout comprising a series of three flaps connected together by first junction lines provided on either side respectively by means of second and third junction lines of a first and a second series of tabs, said central flap of the series of flaps comprising the recesses or tongues corresponding to the tongues or recesses of the first cutout;

the box is formed from two cutouts of corrugated sheet board material, namely a first cutout capable of forming a tray for the bottom of the box, and a second cutout capable of forming the top of said box, said first cutout comprising the tongues or the recesses and said second cutout comprising a series of four flaps connected together by junction lines provided on one side of a series of tabs, said tabs comprising the recesses or tongues corresponding to the tongues or recesses of the first cutout;

the box furthermore comprises corner pieces for centering one box on the other, which are obtained by cutting out tongues at least two corners of the box.

The invention also provides a cutout or a set of cutouts for forming a box as described above.

It also provides a method for producing a box as described above, characterized in that after unstacking the cutout or cutouts from a vertical magazine, the cutouts are moved horizontally in order to bring them finally (that is to say at the end) into the position for shaping the box, and during the travel the tongues with adhesive previously applied are automatically turned over and pressed against the corresponding upper face of the main flap in question in order to adhesively bond them thereon.

It also relates to a device for carrying out the above method.

The invention also provides a device for producing a box of corrugated sheet board material from a cutout or a set of cutouts, the cutout or the set of cutouts comprising a series of main flaps and adjacent tabs capable of forming a rectangular bottom and a top, the lower face of the bottom being provided with at least two recesses, and the top comprising at least two tongues capable of being adhesively bonded onto its upper face, in line with the recesses of complementary shape, said box being arranged in order to be mounted automatically on a shaping station, characterized in that, the recesses and/or the tongues being entirely located inside the corresponding face or faces, the device comprises means for advancing the cutouts flat, one by one, from a stack of cutouts, means for applying adhesive onto the tongues and/or the opposing surface on the upper face of the box, and means for folding the tongues through 180° in order to apply them onto said surface of the upper face during the transfer to the shaping station.

Advantageously, the stack of cutouts being vertical, the means for advancing the stack comprise a plate for elevating the stack to a plane for taking the top cutout, and the device comprises pre-unstacking means arranged in order to separate the top cutout from the rest of the stack and means for aligning said cutout in order to frame it and keep it separated from the rest of the stack in position for gripping by the unstacking means after removal of the pre-unstacking means.

In an advantageous embodiment, the device comprises means for holding at the upper part of the stack when the bottom cutout of the stack has reached a determined level, and means for automatically placing a new stack below the remaining part of the previous stack, which is capable of ensuring continuity of the unstacking.

Advantageously, the means for holding at the upper part comprise free catches pivoting between a position for sliding along the stack of cutouts and a position for supporting the bottom of the stack under the effect of gravity.

Also advantageously, the device comprises means for telemetric measurement of the position ($p_i$) of the top cutout and means for calculating the trajectory of the unstacking means as a function of said position ($p_i$), which are arranged in order to control the movement of said unstacking means between a position for taking the cutout and a position for positioning on a determined workstation, and for calculating during the movement time the trajectory for the next cutout position ($p_{i+1}$), and so on.

In another advantageous embodiment, the device comprises means for assisting the separation of the top cutout from the rest of the stack by blowing grazing air onto the top of the cutout.

Also advantageously, the unstacking means comprise an on-board system provided with a robotized arm for moving said cutout to a subsequent station, with a view to shaping it, before returning empty to take the next top cutout, said robotized arm comprising the means for folding through 180°.

Advantageously, the device comprises at least two magazines and/or stacks of cutouts, from which at least two top cutouts are taken in order to have adhesive applied to them and be placed on one another in order to form a box in at least two parts.

In one advantageous embodiment, the device comprises a station for shaping by winding the cutouts around a determined volume.

The invention will be understood more clearly on reading the following description of embodiments, which are given by way of nonlimiting example.

It refers to the accompanying drawings, in which:

FIGS. 1, 1A, 1B, 1C and 1D illustrate a flat view and a perspective view of two examples of a first embodiment of boxes according to the invention.

Figure 3:
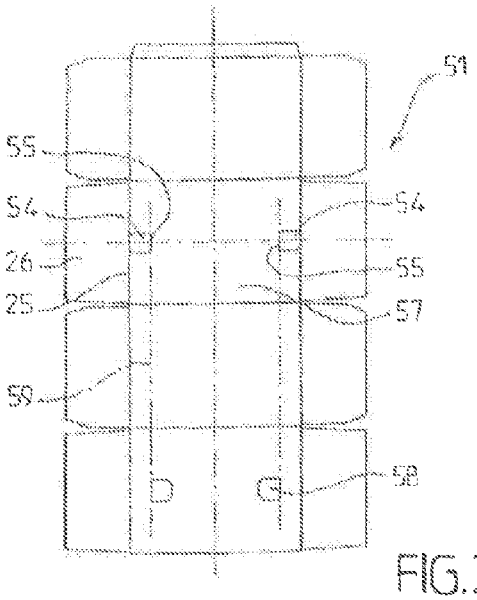
Figure 3A:
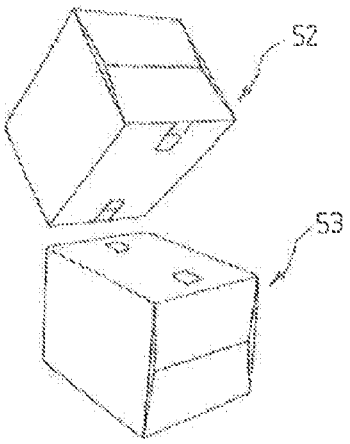

FIGS. 3 and 3A respectively illustrate a cutout in flat view and two boxes obtained, each with such a cutout, to be placed on one another, in perspective, according to one embodiment of the invention, recesses and tongues being arranged in the flaps.

Figure 4:
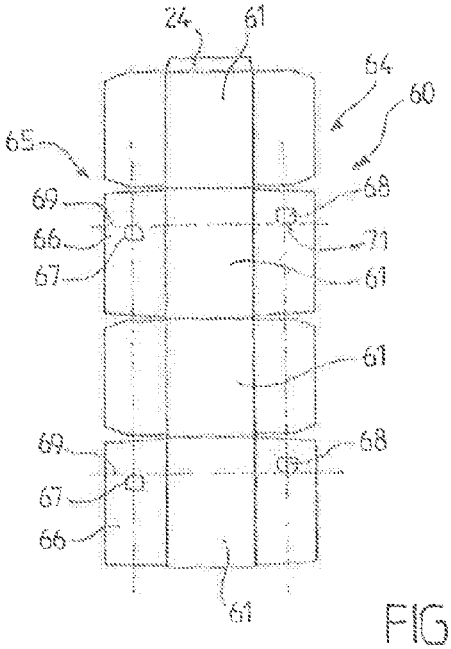
Figure 4A:
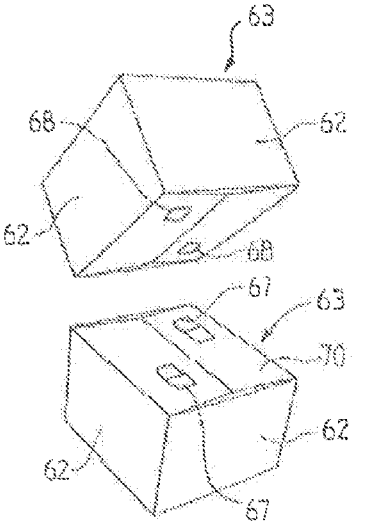

FIGS. 4, 4A; 5, 5A; 6, 6A; 7, 7A; 8, 8A; 9, 9A; 10, 10A and 11, 11A are embodiments according to the invention, respectively of cutouts in the flat state and two boxes in perspective to be placed on one another, the recesses and/or tongues of which are located in the tabs capable of forming the bottoms and upper parts of the boxes.

Figure 12:
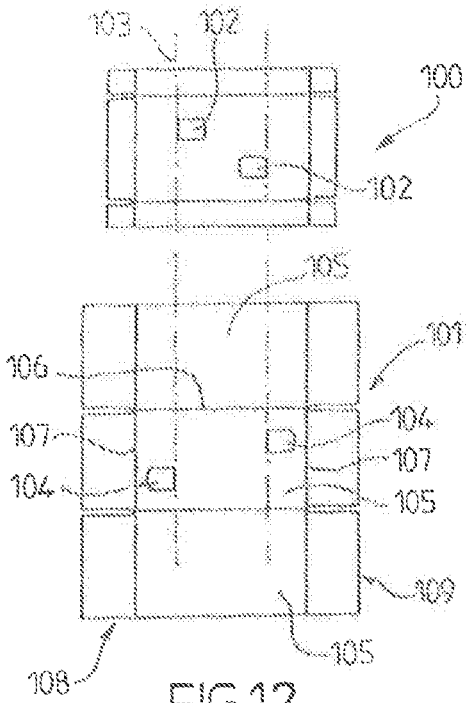
Figure 12A:
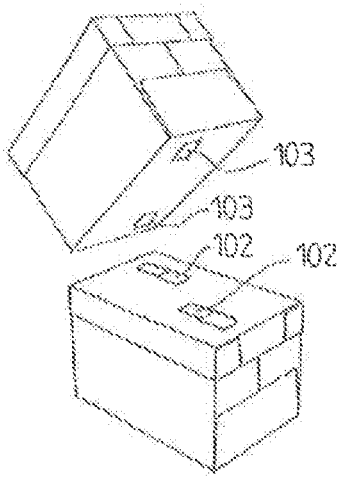

FIGS. 12 and 12A show a set of cutouts in the flat state (FIG. 12) and two boxes (FIG. 12A) in perspective according to another embodiment of the invention, with a tray for forming the bottom and/or the top of the box.

Figure 13:
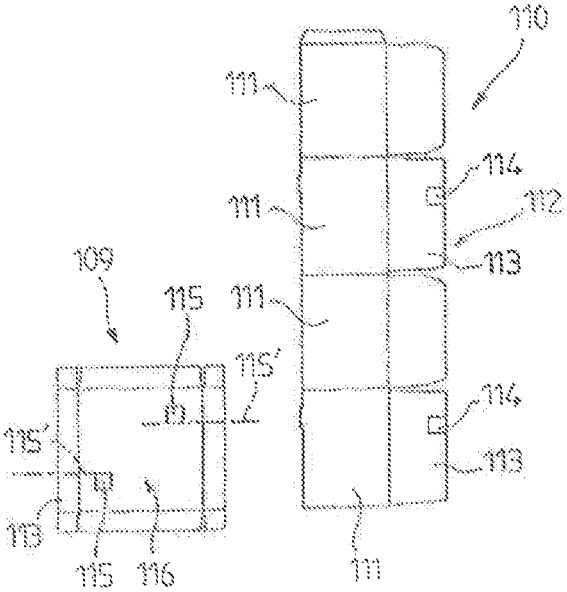
Figure 13A:
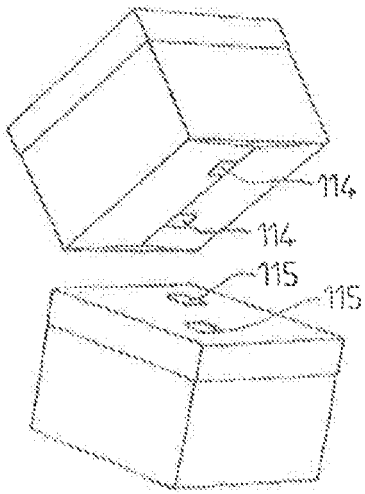

FIGS. 13 and 13A give another set of cutouts and two boxes with trays according to another embodiment of the invention.

Figure 14:
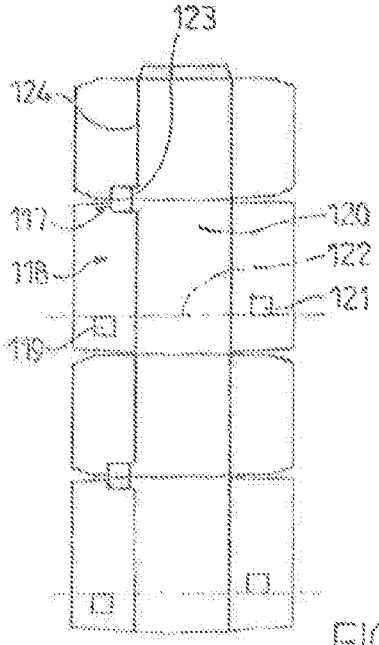
Figure 14A:
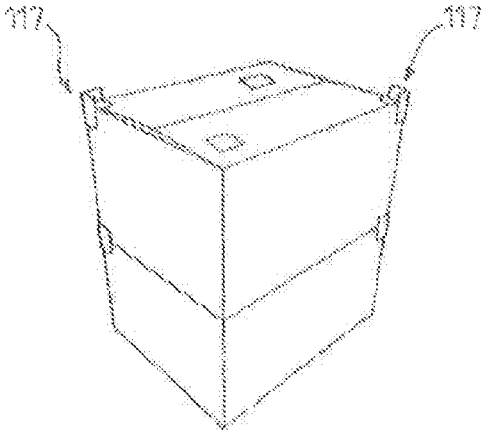

FIGS. 14 and 14A illustrate, in the flat state and in perspective, an example of a characteristic combinable with boxes according to the invention.

Figure 15:
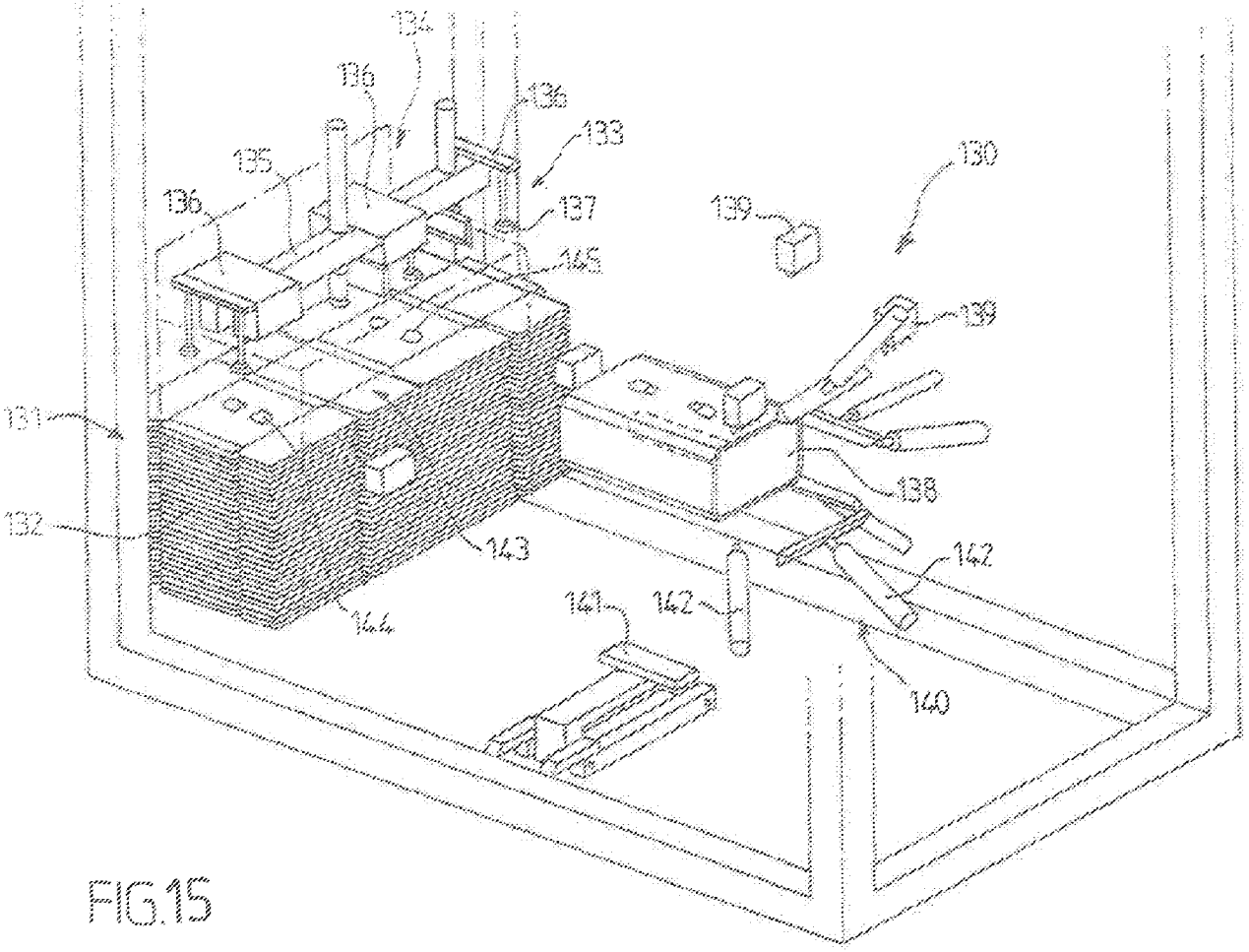
Figure 17:
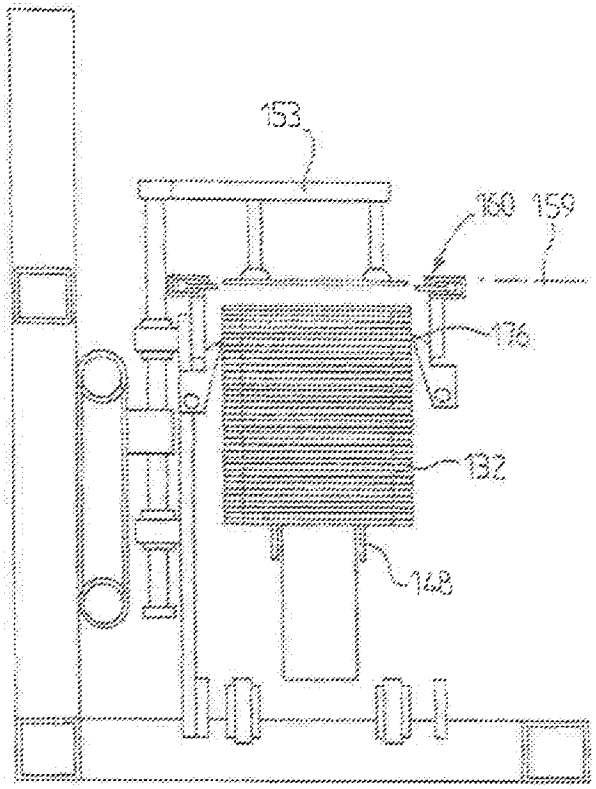

FIG. 15 schematically illustrates a device according to one embodiment of the invention.

FIGS. 16 to 20 show side views of means of advance, pre-unstacking means and means for unstacking a stack, according to the embodiment of the invention more particularly described here.

Figure 21:
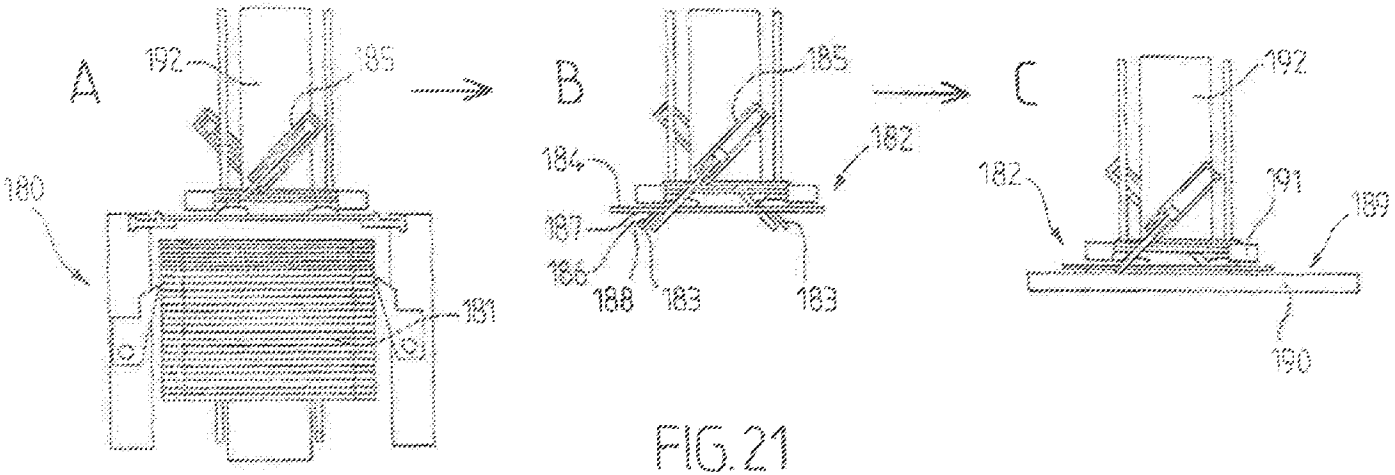
Figure 22:
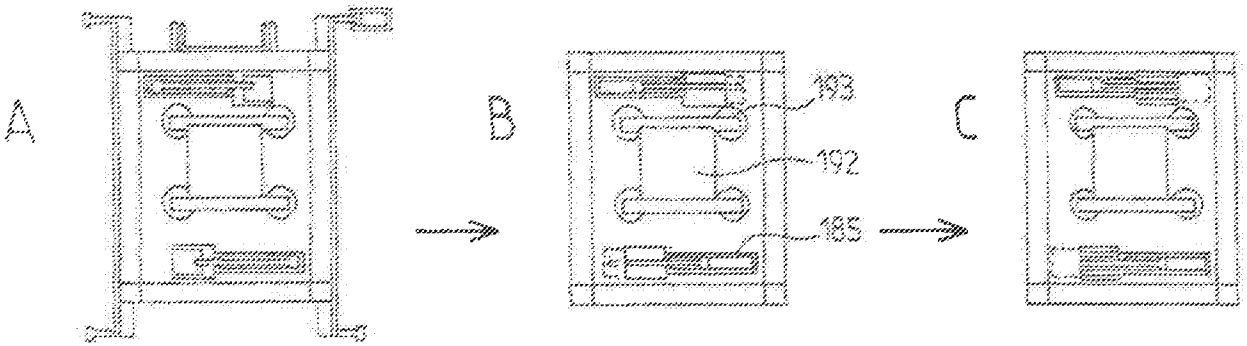

FIGS. 21, 22; 23, 24; 25 and 26 respectively show, in side view and in plan view, the means of advance and folding through 180° the tongues according to 3 embodiments of the invention.

In the rest of the description, the same reference numbers will generally be used to denote elements which are identical or similar.

Figure 1A:
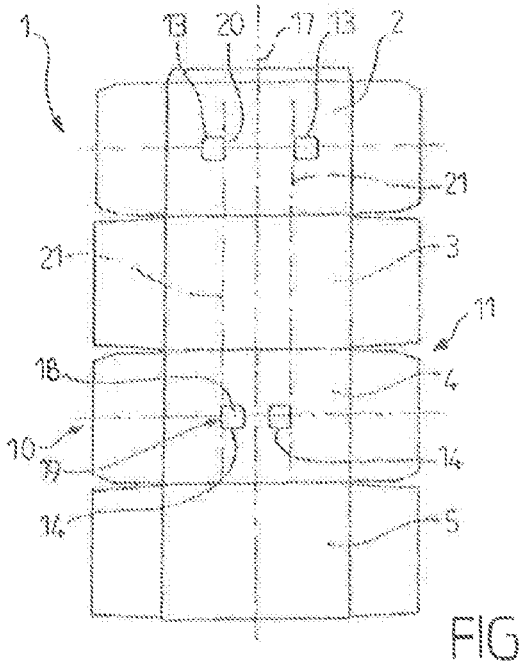

FIG. 1A shows a blank 1 formed from a series of four rectangular flaps 2, 3, 4, 5, for example of identical size, referred to as main flaps.

Figure 1B:
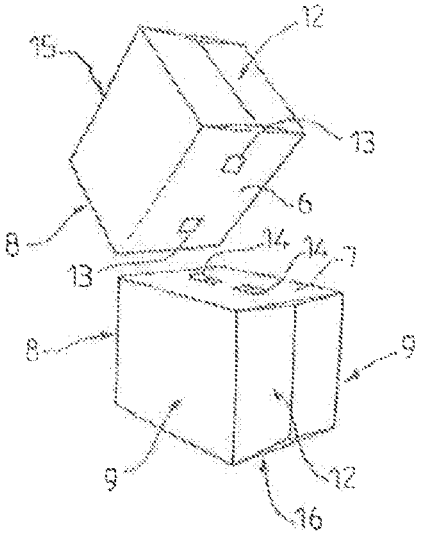

Two of the main flaps 2 and 4 form the bottom 6 and the top 7, which is represented on the parallelepipedal boxes 8 of FIG. 1B.

The blanks are for example made of thin corrugated board, for example with a thickness of from 2 to 3 mm.

The other two flaps 3 and 5 form the opposing side walls 9 of the box.

The sequence of flaps is provided with a first set of tabs 10 on one side and a second set of tabs 11 on the other side, said tabs being of a rectangular shape known per se and capable of at least partly forming two other side walls 12 of the boxes 8, which are adjacent to the opposing first walls 9.

According to the invention, the lower face of the bottom 6 and the upper face of the top 7 respectively have, for one, two recesses 13 of substantially square shape and, for the top 7, two tongues 14 with shapes complementary to the recesses and arranged in order to be adhesively bonded by turning over onto the upper face of the top 7, in line with the recesses 13 of complementary shapes, as shown in FIG. 1B.

Thus, when the upper box 15 is placed on the lower box 16, the recesses will interlock on the tongues adhesively bonded onto the upper face of the top, allowing centering and wedging of one box with respect to the other, which will therefore avoid their relative sliding during their transport.

In the example of FIGS. 1A and 1B, the recesses and the tongues are central with respect to the flaps and respectively symmetrical with respect to a central longitudinal axis 17. Each tongue 14 of the flap 4 forming the top 7 is formed by a cut-out part 18 connected to the flap 4 by a folding line 19, about which the tongue will therefore be able to be turned over in order to be adhesively bonded onto the upper face of the top 7.

This folding line 19 is aligned with the side 20 of the corresponding recess 13, said recess being located on the other side of the alignment line 21 with respect to the tongue, which makes it possible to obtain coincidences for the centering when this tongue is turned over.

Figure 2A:
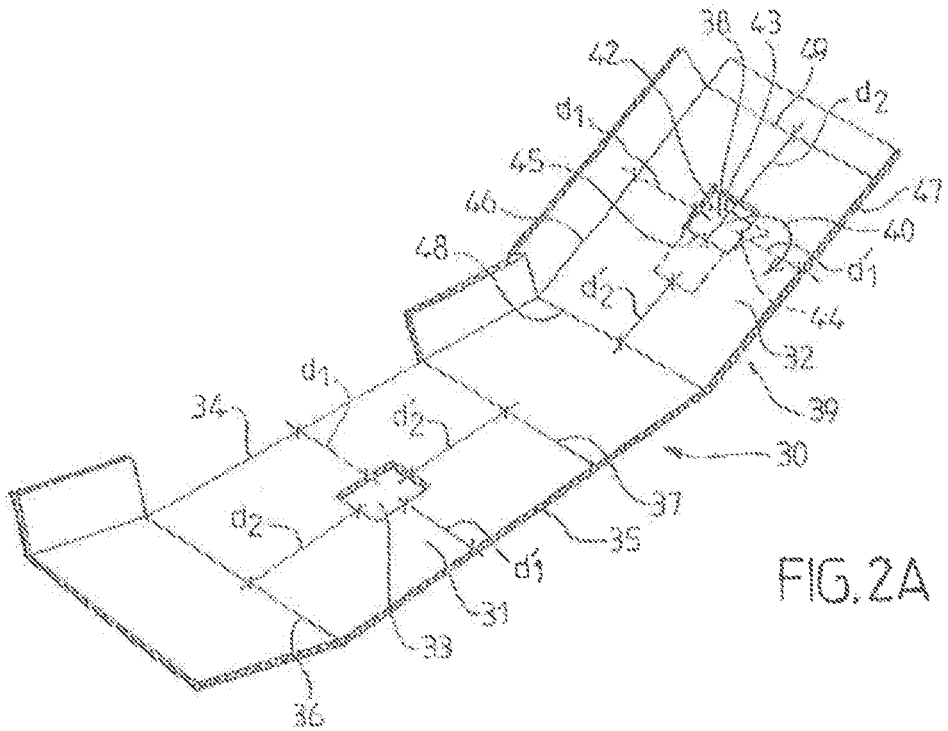
FIGS. 2A and 2B show more precisely in perspective a recess and a tongue (FIG. 2A), and a tongue turned over through 180° and adhesively bonded (FIG. 2B), the two being entirely located inside the face in question, according to one embodiment of the invention.

This will be specified further with reference to FIG. 2A.

In other words, tongues and recesses are located on either side of a line 21, so that when the tongue is turned over about this line, which coincides with the folding line 19, the recess and the tongue which are turned over through 180° will be able to be in line with one another and coincide between two boxes placed on one another.

Figure 1C:
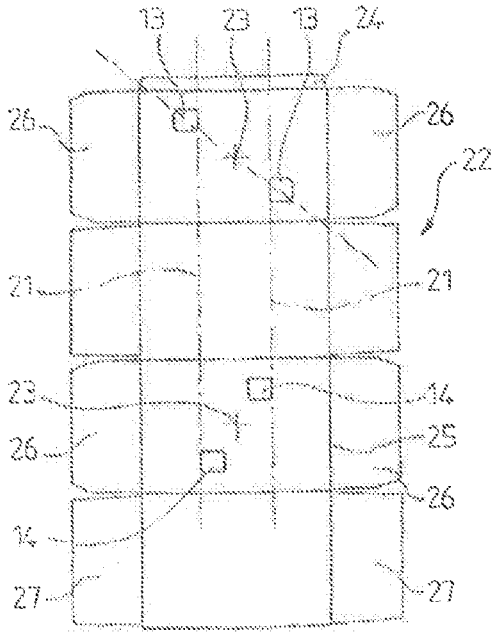
Figure 1D:
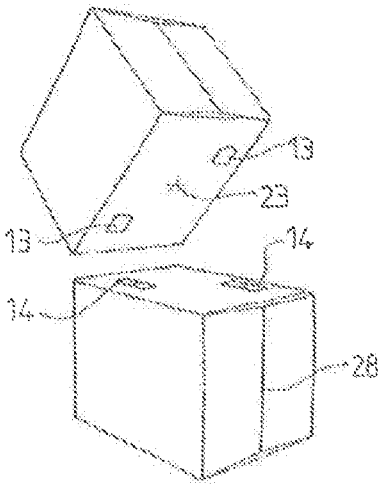

FIG. 1C represents another embodiment of a blank 22 for which the recesses 13 and the tongues 14 are symmetrical with respect to a central point of the flap 23. The rest of the flap 22 is terminated in a known manner, by a rectangular tongue 24 for adhesive bonding onto the adjacent flap during the shaping.

The tabs of the sets 10 and 11 are for their part formed in a manner known per se, by rectangular portions connected by folding lines 25 to the corresponding flaps, namely first tabs 26 which are intended to form an internal part of corresponding flaps 12 and are connected by said folding lines 25 to the flaps 2 and 4 comprising the recesses or the tongues and the tabs 27, which are for their part connected to the flaps 3 and 5 intended to form the walls 9 of the packaging, said tabs being adhesively bonded onto the first flaps and intended to form the walls 12 of the box by being joined at their junction 28 so as to form a complete wall.

Figure 2B:
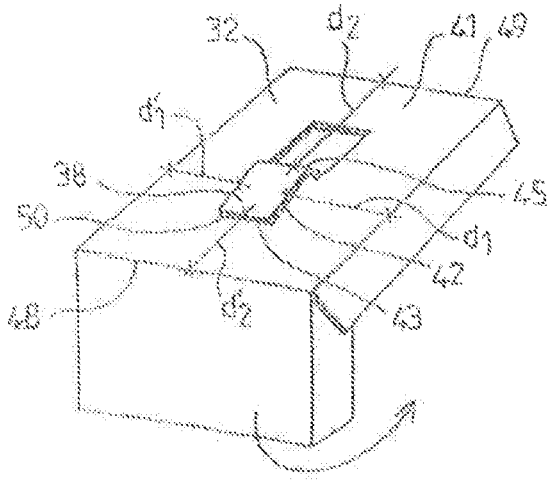

FIGS. 2A and 2B schematically represent in developed perspective (FIG. 2A) and in partly folded perspective (FIG. 2B) a recess and/or a tongue which are used in the boxes and/or cutouts according to the invention.

FIG. 2A shows a cutout portion 30, which comprises the flaps and/or tabs 31 and 32 intended to partly form the upper and lower faces of a box according to the invention.

The flap or tab 31 comprises the recess 33, which is for example rectangular, the edges of which are parallel to the folding lines and are arranged in the flap at respective distances d1 and d'1 from the first folding lines 34 and 35 (with adjacent flap or tab) so that the recess is entirely inside the flap or tab 31 (i.e. for example d1 and d'1 greater than 5 mm and/or very much greater than the thickness of the board, for example greater than two times the thickness).

This time, it is also located, with respect to the folding lines 36 and 37 perpendicular to the former, at distances d2 and d'2 for its cut-out end sides, here again so that the recess is entirely inside the flap or tab in question, in that sense as well.

For its part, the flap 32 comprises the tongue 38 intended to be folded through 180° onto the external wall 39 (arrow 40) so as to obtain (see FIG. 2B) a tongue 38 turned down and adhesively bonded onto the upper face 41 of the external wall 39 of the flap 32. This tongue is cut out on three of its sides 42, 43, 44, and connected to the face of the flap 32 by its fourth side 45, which forms a folding line and which will therefore for example be formed by a double folding line in order to allow the tongue to be turned down better on itself.

From the point of view of its arrangement in the flap 32, this tongue is laterally located at the distances d1 and d'1 with respect to the folding lines with adjacent flaps and/or tabs 46 and 47 corresponding to the folding lines 34 and 35 of the flap from which the recess 33 is cut out.

The distance existing between the folding line 45 of the tongue 38 and the folding lines 48 and 49, capable of respectively being located in line with the folding lines 37 and 36 of the flap or tab arranged in order to form the bottom 31, are such that, when the tongue is folded, its end 50 (cut-out edge 43) is at the distance d'2 from the folding line 48, and therefore in line with its equivalent 37, the folding line 45 being for its part located at the distance d2 from the folding line 49, which will allow coincidence, as can also be seen clearly in FIGS. 1A and/or 1C.

FIGS. 3 and 3A show another embodiment of a blank or cutout 51 and of the corresponding boxes 52, 53, according to the invention.

Here, the tongues 54 are arranged so that their folding line 55 with the upper face of the top is located at a distance equal or substantially equal to the width of the tongue from the junction line 25 between corresponding tab 26 and flap 57.

For their part, the recesses 58 will quite clearly be located on the other side of the line 59, as represented in FIG. 3, entirely inside the corresponding flap, that is to say with their side closest to the folding line of the corresponding flap located at a distance greater than, for example, 5 mm.

FIGS. 4 to 11A represent other embodiments of the invention, in which the box is formed from a blank 60 comprising a series of at least four rectangular main flaps 61 forming the side walls 62 of the box 63. The series of flaps 61 is provided on one side with a first set of tabs 64 forming the bottom of the box, and on the other side with a second set 65 of tabs forming the top.

As in the case of the blanks of the previous embodiments, the series of flaps as of course terminated by an adhesive bonding tongue 24, which will make it possible to form the box in a manner known per se.

The set 65 of flaps comprises two flaps 66, each provided with at least one tongue 67, the set of flaps 64 for its part comprising at least one recess 68 capable of cooperating with the tongue after the latter has been folded about the folding line 69 in order to be adhesively bonded onto the upper face 70 of the box. This folding line 69 is aligned with one of the sides 71 of the recess 68 in correspondence, the latter being located on the other side from the cutout 67 of the tongue with respect to this alignment.

Figure 5:
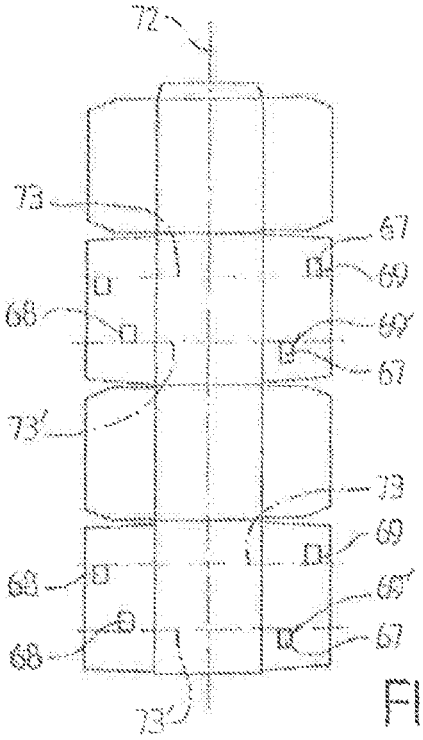
Figure 5A:
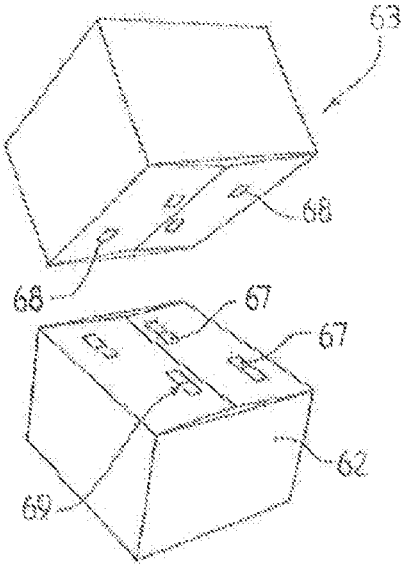

In FIGS. 5 and 5A, there are two tongues per flap, and these will be folded toward the inside of the flap with respect to their folding line 69, 69'.

The situation could, of course, be the reverse, given that the recesses would then be located on the other side of a line 73 drawn in extension of the folding lines 69, 69'. Here, the tongues are small squares, for example with a side length of from 2 to 3 cm.

In the embodiment of FIGS. 4, 4A, 5, 5A, the folding lines 69, 69' of the tongues are perpendicular to the symmetry axis 72 of the series of flaps and tabs.

FIGS. 6, 7, 8, 9 and 10 show other embodiments of cutouts, for which the recesses and tongues are located in the tabs.

Figure 6:
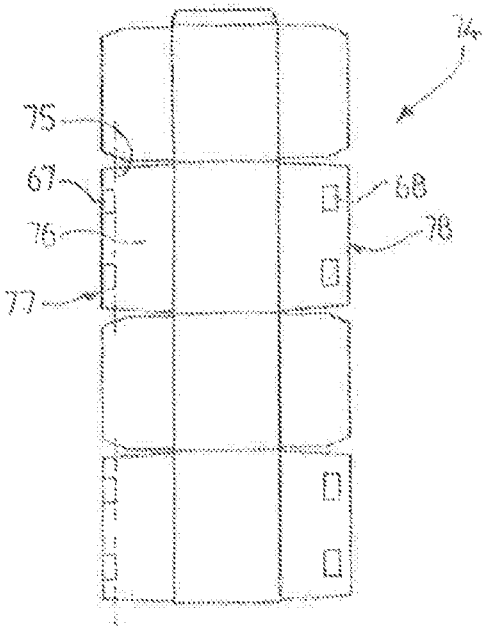
Figure 6A:
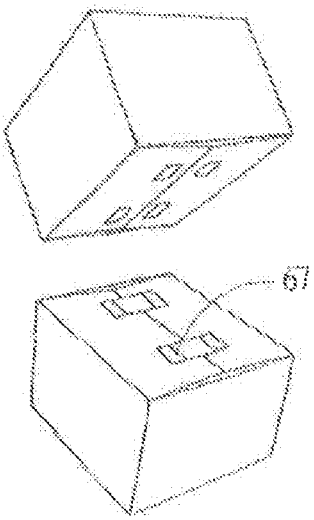

In the embodiment of the cutout 74 of FIG. 6, and of the corresponding boxes of FIG. 6A, the tongues 67 are arranged so that their folding line 75 of junction with the corresponding tab 76 is at a distance from the external edge 77 of said tab equal to the width of the tongue 67, in order to give a tongue configuration as represented in FIG. 6A, the recesses 68 being for their part at a distance from the edge 78 of the corresponding tab equal to said thickness or width of the tongue 67.

Figure 7:
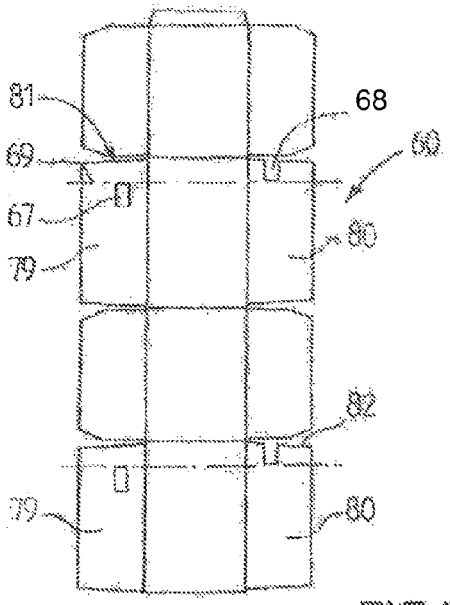
Figure 7A:
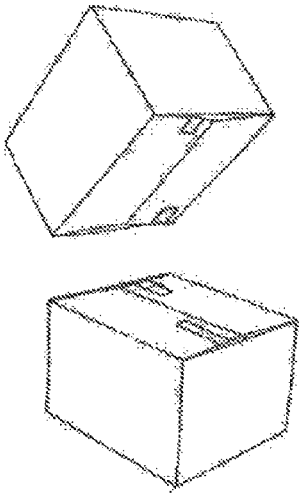
Figure 8:
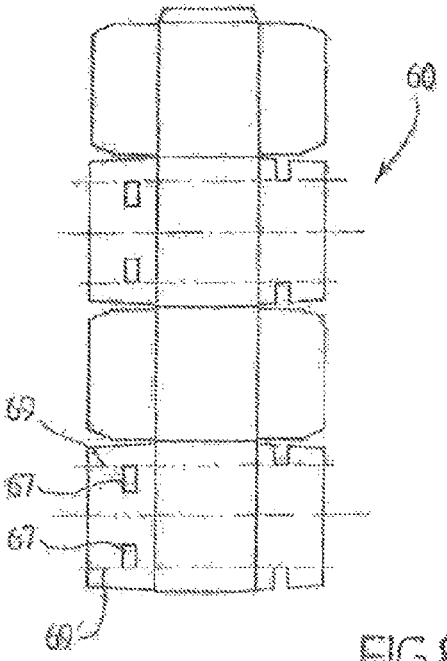
Figure 8A:
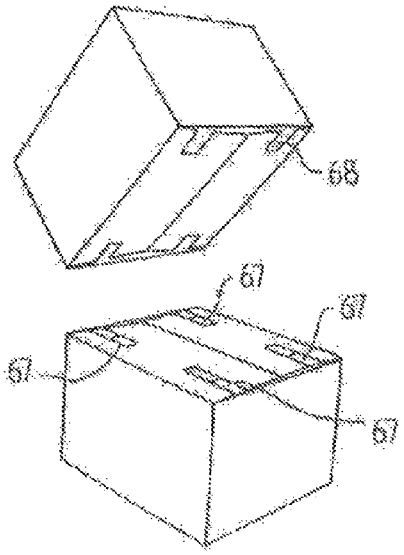

FIGS. 7 and 8 respectively show cutouts 60 provided in one case (FIG. 7) with a single recess and/or tongue per tab and in the other case (FIG. 8) with two recesses and tongues per corresponding tab.

More precisely, FIG. 7 shows tabs 79 and 80, namely a tab 79 provided with a tongue 67, whose folding line of junction with the tab 79 is located at a distance corresponding to the width of the tongue from the side edge 81 of the corresponding tab 79, the recess 68 of the opposing tab being for its part with one of these sides coinciding with the side edge 82 of the tab 80, thus forming a serration.

FIG. 8 corresponds to the embodiment of FIG. 7, but with symmetrical tongues and recesses arranged on the same corresponding tab.

Figure 9:
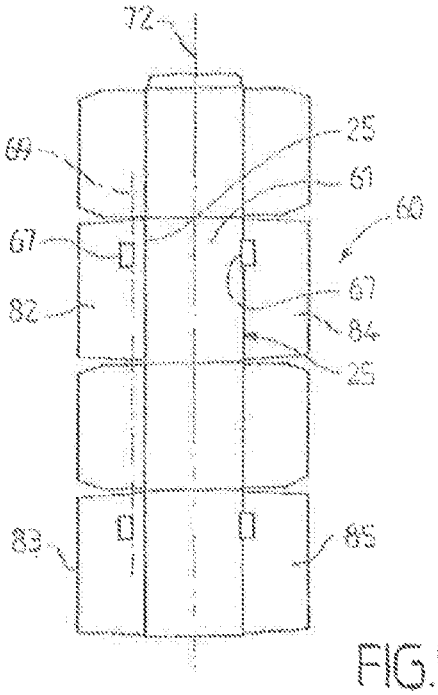
Figure 9A:
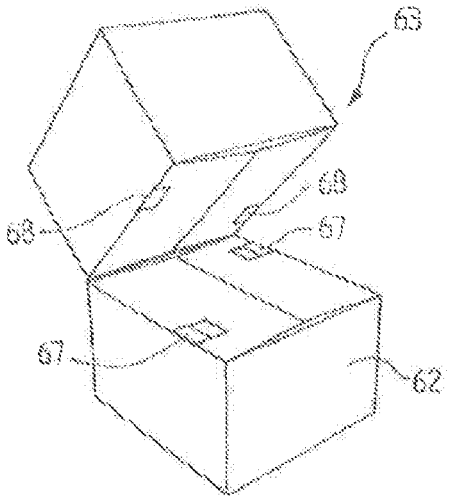
Figure 10:
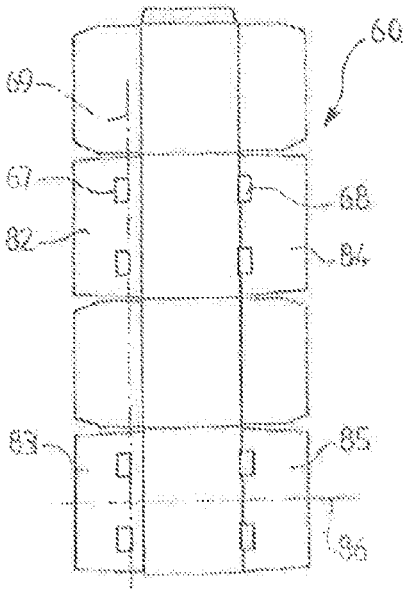
Figure 10A:
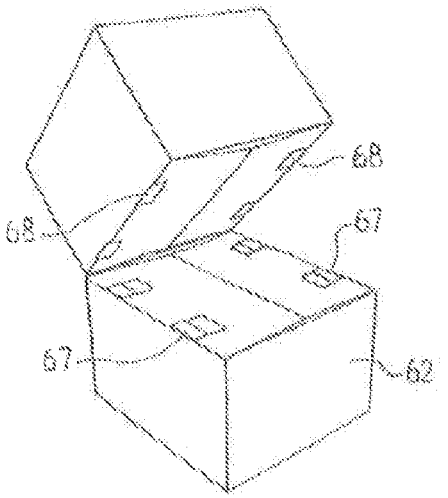

FIGS. 9 and 10 give two other embodiments of cutouts 60 with one (FIG. 9) or two (FIG. 10) tongues per tab 82, 83 and one or two corresponding recesses per opposing tab 84, 85.

More precisely, the tongues 67 are in this case arranged around a folding line 69 which is parallel to the longitudinal axis 72 of the blank, so that, when the tongue is folded inward, its end edges coincide with the folding or junction line 25 between tab 82 and corresponding flap 61. The recess is for its part with one of its edges 67 in coincidence, or substantially in coincidence, with the folding line 25 between tab and flap.

The embodiment of FIG. 10 shows a cutout 60 with two tongues and/or two recesses per tab, which are arranged on either side symmetrically with respect to a transverse line 86.

Figure 11:
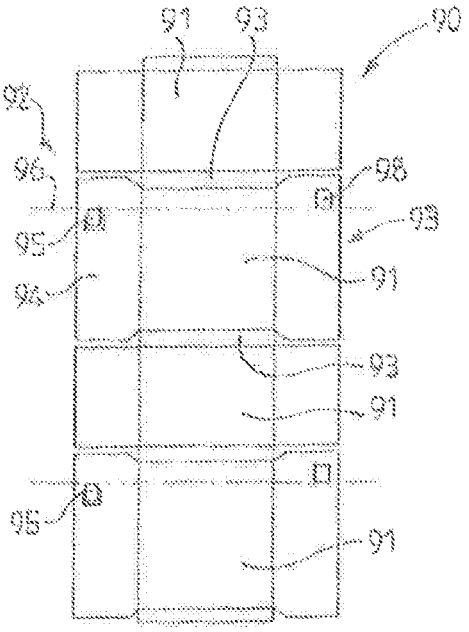
Figure 11A:
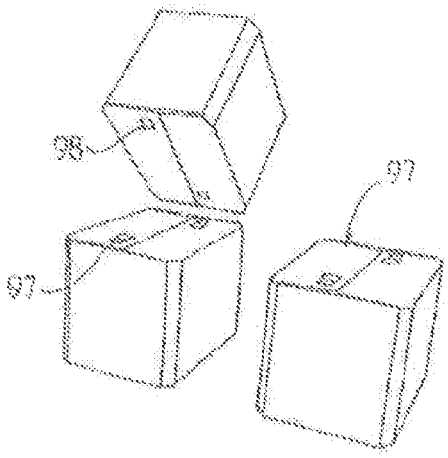

FIG. 11 shows another embodiment of a cutout 90 with eight sides, namely four rectangular main flaps 91 comprising two sets of tabs on either side, namely a first set 92 located on one side and a second set 93 located on the other side, these being connected together by folding lines in a manner known per se, and intermediate flaps 93 capable of forming cut corners (cf. FIG. 11A).

The tabs 94 comprise tongues 95, which will be able to be turned over through 180° about the folding line 96 and adhesively bonded onto the upper surface 97 of the packaging, so that they can subsequently cooperate with the recesses 98 located on the other side of the alignment of the folding line 96 in order to be placed opposing during the placement of one box on the other, as shown in FIG. 11A.

This type of box is advantageously mounted around a mandrel, and permits extremely rapid shaping rates.

FIGS. 12 and 12A show another embodiment of cutouts and boxes according to the invention.

FIG. 12 shows a first cutout 100 capable of forming a tray known per se for forming the bottom of the box, and a second cutout 101 capable of forming the top of the box, or vice versa.

The first cutout comprises tongues 102 which can be turned over about their folding line 103, and the second cutout comprises recesses 104 capable of cooperating with the turned-over tongues 102.

The second cutout 101 comprises a series of three flaps 105 connected together by first folding lines 106 provided on either side respectively by means of second and third junction lines 107 of a first 108 and a second 109 series of tabs, the central flap of the series of flaps comprising the recesses and the central flap of the tray comprising the tongues.

The situation could, of course, be the reverse.

FIG. 13 shows another embodiment, comprising a first cutout 109 made of corrugated board and capable of forming a tray for the bottom of the box, here again in a manner known per se, which will comprise the tongues, and a second cutout 110 comprising a series of four flaps 111 connected together by junction lines and connected by a perpendicular junction line and on one side to a series 112 of tabs, said tabs comprising two tabs 113 provided with recesses 114, for example arranged with one of their sides coincident with the external edge of the tab 113.

In this case, the tongues 115 located on the central flap 116 of the tray are arranged in order to be folded about a folding line 115' located at a distance from the junction line with the tab of the tray corresponding to the width of the tongue 115.

Further to the particular characteristics of the invention associated with the positions of the tongues and of the recesses, it is of course possible to supplement the packaging and/or box in question with other arrangements, for example those represented with reference to FIG. 14.

Here, corner pieces 117 are provided, formed by cutouts of the side edges of the tabs 118 on which the tongues 119 have been placed, at the corner with the junction of the flaps 120 corresponding to the tabs on which the tongues 119, arranged to cooperate with the opposing recesses 121 located on the other side of the line 122 corresponding to the folding line of the tongue 119, are fixed.

These corner pieces are, for example, formed by a part 123 projecting from the extension of the junction line 124 between tab and corresponding flap on the side of the exterior of the cutout and cooperate with the corner of the opposing box above, around which it is interlocked.

One or more embodiments of the device and method according to the invention, making it possible to form the boxes as described above, will now be described with reference to FIGS. 15 to 26.

Specifically, these pose a manufacturing problem in particular when turning over the tongue, which has to be done efficiently, rapidly and at a high rate from a tongue grip which is centered and/or positioned inside one of the flaps and/or one of the tabs.

This is possible only by virtue of cutout gripping means arranged in order to be adapted to bring said cutouts particularly precisely and repetitively, and at a high rate, in front of the location for processing and/or shaping, for example around a mandrel.

More precisely, FIG. 15 schematically shows a device 130 for shaping a box as described above, comprising at least one vertical magazine 131 with a constant level, for storing a stack 132 of cutouts of corrugated board for example of the type described with reference to FIG. 11.

The device 130 comprises means (described below) for advancing the stack as it is being unstacked, and means 133 for unstacking the cutouts by suction.

The stack of cutouts 132 being vertical, the means of advance comprise a plate (described below with reference to FIG. 16 and the subsequent figures) for elevating the stack vertically as far as a plane for taking the cutout.

The unstacking means 133 comprise a system 134 formed by a horizontal arm 135 provided, for example, with three parallel branches 136 for supplying compressed air and for positioning six suckers 137, for example two per branch, for gripping by suction, in a manner known per se.

The arm 135 can be moved horizontally, for example by means of a chain and/or an electric motor (not represented) between the position for gripping the cutouts above the magazine and the subsequent step, for example folding around a mandrel 138.

Application by the guns 139 of liquid adhesive under pressure, of the type known by the term "hot melt", is provided, the box being formed by compression on the mandrel by presser means 140 (lower pusher plate 141 capable of being deployed vertically, lateral pusher cylinders 142, etc.).

In the example described here, the cutout 143 comprises eight flaps, namely four main flaps separated by small intermediate flaps forming cut corners and terminated by a tongue for adhesive bonding onto the end intermediate flap.

As specified above, the flaps are provided on either side on the cutouts according to the invention with tabs intended to form the bottom and the top of the box.

Recesses 144 and tongues 145 are provided on two of the main flaps of the cutout 143.

FIGS. 16 to 20 more precisely show in side view the means for advancing the stack and the pre-stacking means 146 according to the embodiment of the invention more particularly described here.

The means 133 for advancing the stack comprise an elevator plate 147, for example formed by two angle pieces 148 for horizontal support of the last cutout at the bottom of the stack 132 and a vertically pushing cylinder 149, controlled by an automaton 150 ensuring programmed raising of the plate as the cutouts are removed, which is controlled by optical measuring means 151.

More precisely, these optical means are associated, by means known per se, with means 151 of the laser reader type for telemetric measurement of the position $p_i$ of the top cutout and means 152 (microprocessor) for calculating the trajectory of the unstacking means 133 as a function of the position $p_i$, arranged in order to control the movement of the unstacking means between a position for gripping the cutout and a position for positioning on a determined workstation, such as the mandrel, and in order to calculate in masked time, that is to say during the movement time, the trajectory for the next cutout position ($p_i$+1), and so on.

The time diagram followed is, for example, of the following type:

- initialization with selection of the offset values according to a format stored in a database,
- movement of the robotized arm to the reference of the magazine and as a function of the offsets of the format,
- reading by telemetry of the initial position if need be and/or calculation of the initial position,
- calculation of the forward trajectory,
- realignment with the reference of the magazine of cutouts,
- once the position has been reached, calculation then lowering onto the cutout according to predetermined values or according to values which are measured by using the telemetry,
- evacuation of the suckers in order to suction the cutout,
- execution of the trajectory then, if necessary, reading the telemetry height,
- calculation of the return trajectory or otherwise taking the parameters of the trajectory from the database,
- turning off the vacuum in order to release the cutout at the appropriate position,
- execution of the return trajectory, and
- restarting the cycle.

The pre-unstacking means 146 comprise a horizontal robotized arm 153 provided with at least four suckers 154 for gripping the cutout, the arm being fixed to a vertical rod 155 which is off-center with respect to the stack and arranged at the side of the latter.

The rod 155 guided and fixed by a sleeve 156 to a chain 147 for actuation between a gripping position 158 (in dots and dashes in FIG. 16), a position 159 (FIG. 17) for withdrawal of the cutout above the alignment means 160, a position 161 (FIG. 18) for depositing the cutout on said alignment means 162 and a position 163 (FIG. 19) for withdrawal heightwise and laterally, allowing the unstacking means 133 (arm 135) to take the aligned cutout.

Figure 16:
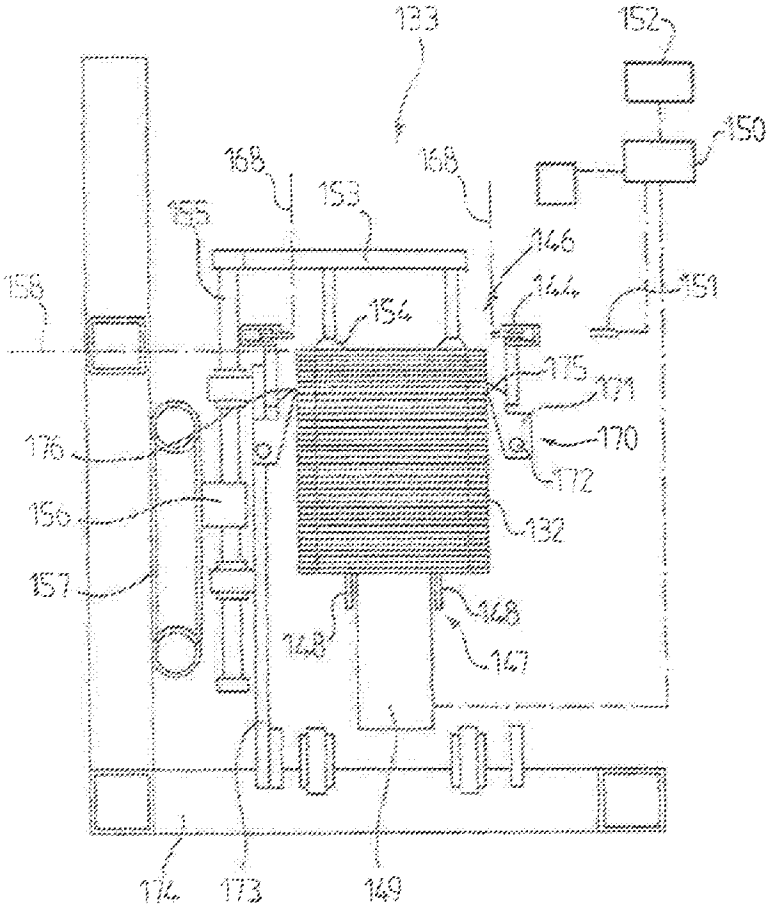
Figure 19:
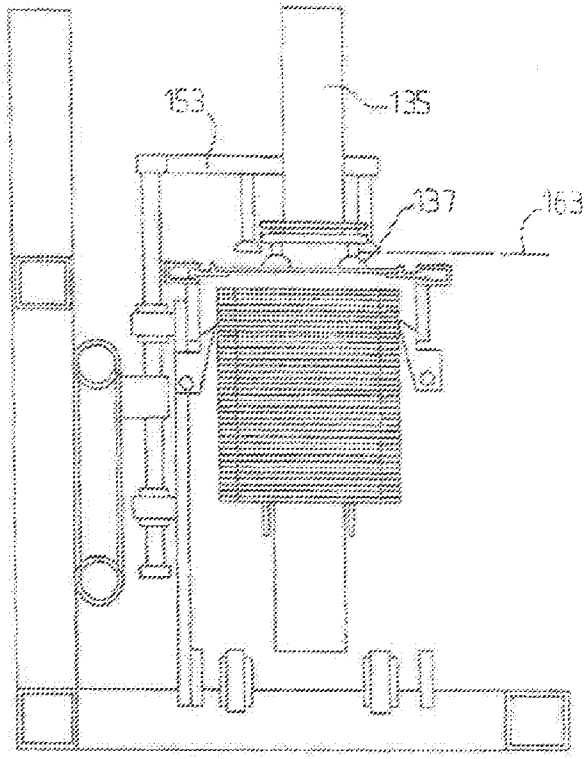
Figure 18:
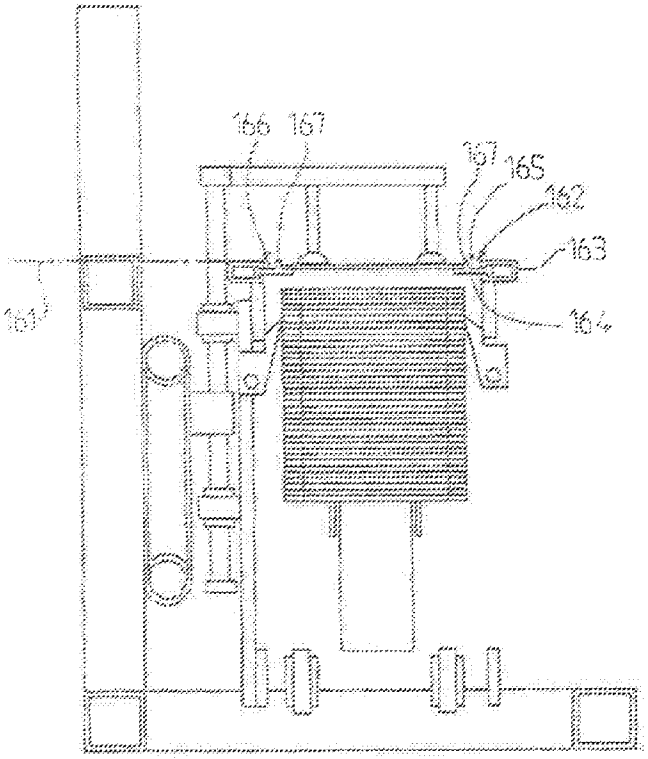

More precisely, the alignment means 162 comprise, on either side of the volume occupied by the vertically mobile stack 132 of cutouts, two chutes 163, for example formed by two tubes having a C-shaped cross section, of which the opening of the branches lies on the side of the stack and in which at least two sliding catches 164 are respectively mounted movably in translation parallel to the branches of the C, these catches being formed by metal tongues provided in the upper part 165 with a lug 166 for wedging the periphery 167 of the blank, in order to frame it precisely and hold it on said catches in abutment positioning once they have moved from their release position 168 in dots and dashes (see FIG. 16). The catches 164 are, for example, activated by a system of small cylinders with return springs (not represented) for returning to the nominal release position at rest.

They are controlled by the automaton 150 in order to move said catches between their abutment position and their release position.

During the pre-unstacking, the top cutout is separated from the stack below by using means (not represented) for blowing from the top onto the cutout being separated, which allows it to be detached effectively with a high rate (more than thirty or forty, or even fifty cutouts per minute).

During the operation of the pre-unstacking and unstacking means, the stack 132 of cutouts is emptied and the plate formed by the angle pieces 148, which support the last cutout, rises. There comes a time when it is in a position such that the means 170 for holding in the upper part of the stack can be automatically triggered. These means consist, for example, of catches 171 formed by a piece which is free and/or mobile in rotation with respect to an axle 172 secured to a rod 173 secured to the chassis 174 of the device.

The catches have an end lug 175 arranged to slide along the edge of the stack.

The lug 175 has, for example, a substantially triangular cross section forming a tip for contact with the edge of the stack 176.

Figure 20:
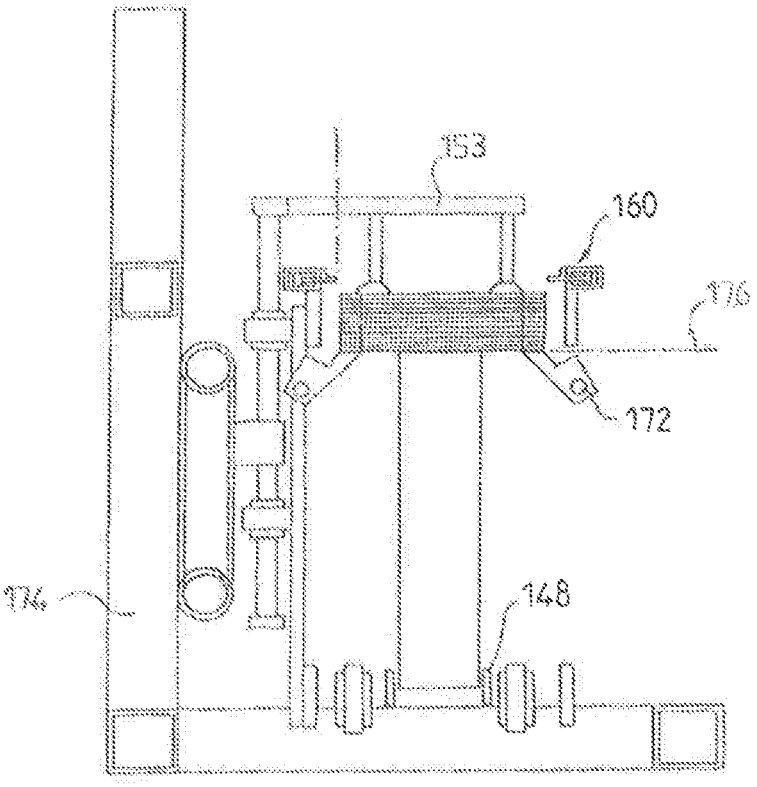

When the tip of the lug 175 is no longer in contact with the edge of the stack, because it is too high, the catch pivots about its axle 172 (cf. FIG. 20).

It is then arranged in order to be placed in a horizontal abutment position (in dots and dashes 176), on which the last cutout can rest, releasing the plate formed by the angle pieces 148.

It is then possible to relower it by actuating the pusher cylinder vertically as far as its initial position. A new stack of cutouts may then be placed on the plate, for example by pushing it from a pallet. It is then sufficient to raise the stack until it comes in contact with the lugs 175, which will then pivot until the last cutout of the rest of the stack above comes in contact with the first cutout of the stack below.

A stack is thus fully reconstituted without a break in loading for manufacturing boxes according to the invention.

FIGS. 21 to 26 represent means 180 for advancing the cutouts 181 flat one by one from a magazine, and an unstacking and pre-unstacking device such as that described above.

The device comprises means for applying adhesive onto the tongues as described above, and/or the surface capable of being placed in opposition after folding.

Three types of embodiment of the means 182 (FIG. 21), 183 (FIG. 23) and 184 (FIG. 25) are provided for folding the tongues through 1800 in order to apply them onto said surface of the upper face during and/or after transfer to the shaping station.

In the embodiment of FIGS. 21, 22, the tongues 183 of the cutout 184 are cut out therefrom in said cutout according to the descriptions above, are pushed by means of oblique cylinders 185 in order to make them adopt a position pre-folded through more than 90° (see arrow 186), one and/or other of the opposing zones on one side 188 on the cutout and on the other side 188 on the tongue previously having adhesive applied to them.

The adhesive bonding of the tongues is completed on the path to the shaping station by pressurizing (station C) the tongues by means of a tool 189 comprising a plate 190 and a backing plate 191. The cutout may subsequently be brought to the shaping station.

The cylinders 185 and the counter-pressure means 191 are onboard the unstacking means 192 of the type described with reference to the preceding figures.

For its part, the cutout is still held by means of the gripping suckers 193 of the unstacking means 192.

Figure 23:
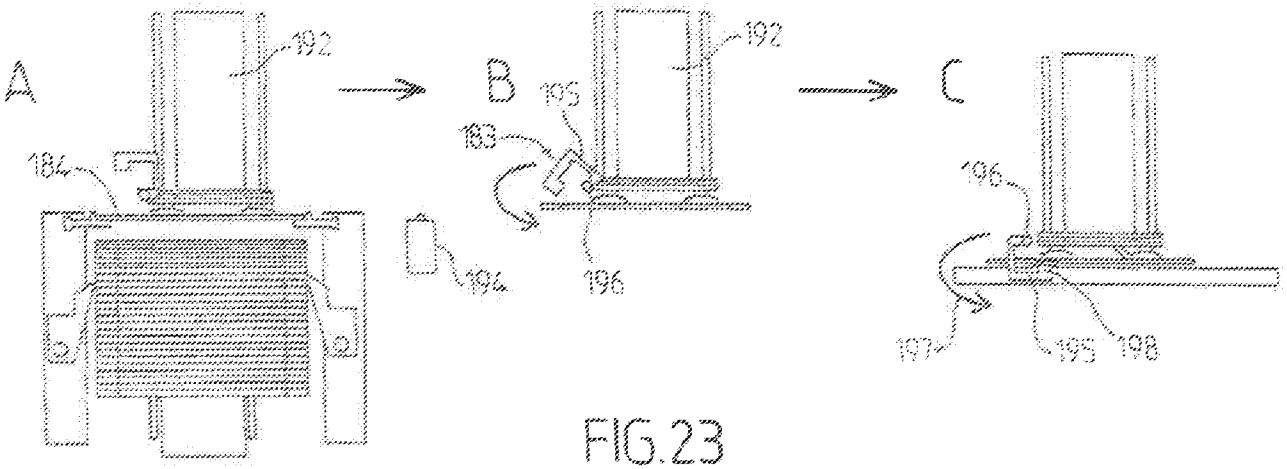
Figure 24:
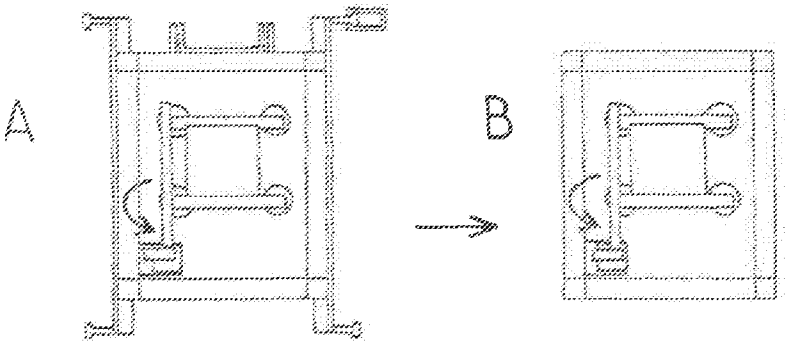

FIGS. 23 and 24 represent the means 183 for folding the tongues through 1800, which can be used here at high speed.

This involves wrapping upwards. The cutout 184 is gripped by the unstacking means 192 then, after adhesive application at 194, the tongue is separated by means of a piece 195, mounted articulated about an axle 196 secured to the unstacking means 192, between a release position above the cutout (station B) and a position for pressing the tongue onto the lower face of the cutout (station C) by means of rotation (arrow 197). This piece has a hook shape with an end part 198 making it possible to compress the tongue onto the cutout from below.

Counter-pressure means (not represented) are also provided.

Figure 25:
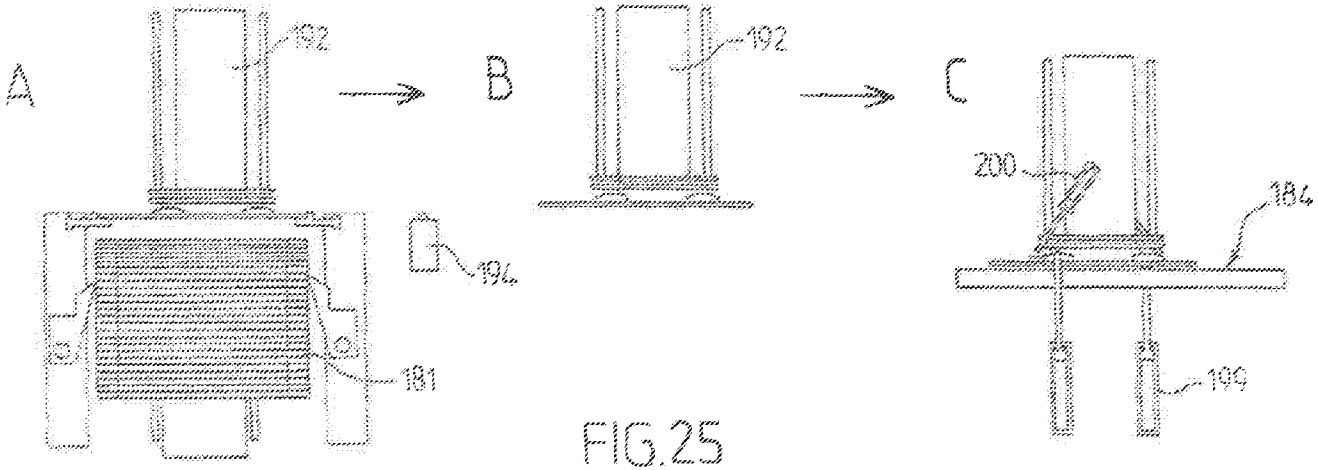
Figure 26:
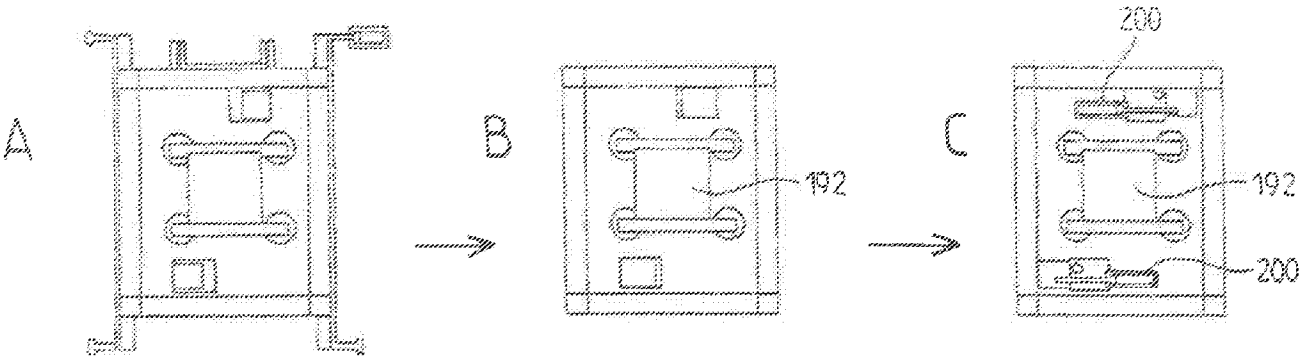

Lastly, FIGS. 25 and 26 represent another embodiment of the means 184 for folding the tongues through 180° in order to apply them onto the surface of the upper surface, in this case wrapping downwards.

The means 184 comprise vertical folding cylinders 199, which push the tongue from below, which is then taken up by the pressing cylinders 200 from above with an angle at 45°, for example, with respect to the vertical.

These operations are carried out continuously, for example at the time of transferring the cutout.

The operation of a device for forming boxes according to the embodiment of the invention more particularly described here will now be described more particularly with reference to FIG. 15 and the subsequent figures.

Starting from a cutout taken from the vertical stack 132, made of corrugated sheet board material and comprising the recesses and the tongues entirely located inside the flaps, as described above, and after unstacking said cutout from the vertical magazine, it is moved horizontally to bring it to the shaping position. After gripping of the cutout extremely precisely by using the particular alignment and pre-unstacking device allowing such precision and/or using telemetric measuring means making it possible to calculate the trajectory exactly, and by detaching the cutout by blowing, the cutout is moved in order to apply thereon, during movement, adhesive lines either on the tongue or on the part which will be in contact with the tongue after folding, then said tongue is pressed onto the corresponding upper faces of the main flap in question by means of one of the devices as described above, selected as a function of the desired forming speed.

The box is then shaped around the mandrel, as described with reference to FIG. 15, the recesses and the tongues being entirely located inside the corresponding faces.

As is evident, and as moreover emerges from the description above, the present invention is not limited to the embodiments more particularly described. Rather, it encompasses all variants thereof, and particularly those in which the means for folding the tongues and applying adhesive are different, or those in which the tongues are located on the bottom of the box and the recesses are arranged on the top.

The invention claimed is:

1. A packaging box made of corrugated board, comprising walls, a bottom and a top, a lower face of the bottom being provided with at least two recesses and the top comprising an upper face and at least two tongues adhesively bonded onto the upper face, the recesses being complementary in shape to the tongues which are in line with the recesses, characterized in that the recesses and/or the tongues are entirely located inside the corresponding face or faces, the tongues being each formed by a portion of the upper face of the top, cut out on a first part and connected by a second part to said upper face by a folding line.

2. The box as claimed in claim 1, characterized in that the portion forming the tongues is rectangular or trapezoidal, the first part being delimited by three sides and the second part by the fourth side forming the folding line.

3. The box as claimed in claim 1, characterized in that the first part of the tongues is of rounded shape.

4. The box as claimed in claim 1, characterized in that the box is formed from a blank comprising a series of at least four main flaps, two of the main flaps forming the bottom and the top of the box, and the other two main flaps forming two opposing first side walls, said series being provided on one side with a first set of tabs and on the other side with a second set of tabs, said first and second set at least partly forming the other two side walls adjacent to the opposing first walls, said recesses and said tongues being formed in said main flaps forming the bottom and the top.

5. The box as claimed in claim 4, characterized in that the tongues and the recesses are central with respect to the main flaps forming the bottom and the top, and respectively symmetrical with respect to a central longitudinal axis of the series of flaps.

6. The box as claimed in claim 4, characterized in that the tongues are symmetrical with respect to a central point of the main flap forming the top, and the recesses are symmetrical with respect to a central point of the main flap forming the bottom.

7. The box as claimed in claim 5, characterized in that the folding line of the second part of the tongues formed by a portion of the upper face of the top is located at a distance from a junction line between a tab and a corresponding main flap equal to the width of the tongue.

8. The box as claimed in claim 1, characterized in that the box is formed from a blank comprising a series of at least four main flaps forming the side walls of the box, said series being provided on one side with a first set of tabs forming the bottom of the box and on the other side with a second set of tabs forming the top, said recesses and said tongues being formed in said tabs.

9. The box as claimed in claim 8, characterized in that the tongues and the recesses are centered in width with respect to the tabs in which they are formed.

10. The box as claimed in claim 8, characterized in that each tab in which tongues or recesses are formed comprises two recesses or two tongues.

11. The box as claimed in claim 8, characterized in that the tongues have a segment of the first cut-out part opposite the second part connected to the upper face by a folding line, which coincides with an external edge of a corresponding tab.

12. The box as claimed in claim 8, characterized in that each recess is located at a border of a lateral side of a corresponding tab.

13. The box as claimed in claim 8, characterized in that each recess has a cut-out side which coincides with a junction line between a tab and a corresponding main flap.

14. The box as claimed in claim 1, characterized in that the box comprises eight sides, namely four main flaps and four intermediate flaps forming cut corners, and characterized in that it is formed around a mandrel.

15. The box as claimed in claim 1, characterized in that the box is formed from two cutouts of corrugated sheet board material, namely a first cutout capable of forming a tray for the bottom of the box and a second cutout capable of forming the top of said box, said first cutout comprising the recesses and said second cutout comprising a series of three flaps connected together by first junction lines provided on either side respectively by means of second and third junction lines of a first and a second series of tabs, said central flap of the series of flaps comprising the tongues corresponding to the recesses of the first cutout.

16. The box as claimed in claim 1, characterized in that the box is formed from two cutouts of corrugated sheet board material, namely a first cutout capable of forming a tray for the bottom of the box, and a second cutout capable of forming the top of said box, said first cutout comprising the recesses and said second cutout comprising a series of four flaps connected together by junction lines provided on one side of a series of tabs, said tabs comprising the tongues corresponding to the recesses of the first cutout.

17. The box as claimed in claim 1, characterized in that the box comprises corner pieces for centering one box on the other, which are obtained by cutting out tongues at least two corners of the box.

18. A cutout or set of cutouts for forming a packaging box, characterized in that the cutout or set of cutouts comprises a series of main flaps and adjacent tabs capable of forming a rectangular bottom and a top, a lower face of the bottom being provided with at least two recesses, and the top comprising an upper face and at least two tongues capable of being adhesively bonded onto the upper face, the recesses being complementary in shape to the tongues which are in line with the recesses, and characterized in that the recesses and/or the tongues are entirely located inside the corresponding face or faces, the tongues being each formed by a portion of the upper face of the top, cut out on a first part and connected by a second part to said upper face by a folding line.

19. The cutout or set of cutouts as claimed in claim 18, characterized in that the portion forming the tongue is rectangular or trapezoidal.

20. The cutout or set of cutouts as claimed in claim 18, characterized in that the portion forming the tongue has a rounded first part.

21. The cutout as claimed in claim 18, characterized in that the cutout is formed from a blank comprising a series of at least four main flaps, two of the main flaps forming the bottom and the top of the box, and the other two forming two opposing first side walls, said series being provided on one side with a first set of tabs and the other side with a second set of tabs, said sets forming the other two side walls adjacent to the opposing first walls, said recesses and said tongues being formed in said main flaps forming the bottom and the top.

22. The cutout as claimed in claim 21, characterized in that the tongues and the recesses are central with respect to the main flaps forming the bottom and the top, and respectively symmetrical with respect to a central longitudinal axis of said series.

23. The cutout as claimed in claim 21, characterized in that the tongues are symmetrical with respect to a central point of the main flap forming the top, and the recesses are symmetrical with respect to a central point of the main flap forming the bottom.

24. The cutout as claimed in claim 22, characterized in that the folding line of the second part of the tongues, which are formed by a portion of the upper face of the top, coincides with a junction line between a tab and a corresponding main flap.

25. The cutout as claimed in claim 18, characterized in that it the cutout is formed from a blank comprising a series of at least four main flaps, forming the side walls of the box, said series being provided on one side with a first set of tabs forming the bottom of the box and on the other side with a second set of tabs forming the top, said recesses and said tongues being formed in said tabs.

26. The cutout as claimed in claim 25, characterized in that the tongues and the recesses are centered in width with respect to the tabs in which they are formed.

27. The cutout as claimed in claim 25, characterized in that each tab in which tongues or recesses are formed comprises two recesses or two tongues.

28. The cutout as claimed in claim 25, characterized in that the tongues have a segment of the first part opposite the second part connected to the upper face by a folding line, which coincides with an external edge of a corresponding tab.

29. The cutout as claimed in claim 25, characterized in that each recess is located at a border of a lateral side of a corresponding tab.

30. The cutout as claimed in claim 25, characterized in that each recess has a cut-out side which coincides with a junction line between a tab and a corresponding main flap.

31. The cutout as claimed in claim 18, characterized in that it the cutout comprises eight sides, namely four main flaps and four intermediate flaps forming cut corners, and characterized in that the cutout is arranged in order to form a box by wrapping around a mandrel.

32. The set of cutouts as claimed in claim 18, characterized in that the set of cutouts is formed from two cutouts of corrugated sheet board material, namely a first cutout capable of forming a tray for the bottom of the box and a second cutout capable of forming the top of said box, said first cutout comprising the recesses and said second cutout comprising a series of three flaps connected together by first junction lines provided on either side respectively by means of second and third junction lines of a first and a second-series of tabs, said central flap of the series of flaps comprising the tongues corresponding to the recesses of the first cutout.

33. The set of cutouts as claimed in claim 18, characterized in that the set of cutouts is formed from two cutouts of corrugated sheet board material, namely a first cutout capable of forming a tray for the bottom of the box, and a second cutout capable of forming the top of said box, said first cutout comprising the recesses and said second cutout comprising a series of four flaps connected together by junction lines provided on one side of a series of tabs, said tabs comprising the tongues corresponding to the recesses of the first cutout.

* * * * *